US007140712B2

(12) United States Patent
Naka et al.

(10) Patent No.: US 7,140,712 B2
(45) Date of Patent: Nov. 28, 2006

(54) LIQUID CARTRIDGE

(75) Inventors: Takahiro Naka, Nagano (JP); Atsushi Kobayashi, Nagano (JP); Satoshi Shinada, Nagano (JP); Yasuto Sakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 182 days.

(21) Appl. No.: 10/691,338

(22) Filed: Oct. 22, 2003

(65) Prior Publication Data

US 2004/0263572 A1 Dec. 30, 2004

(30) Foreign Application Priority Data

Oct. 22, 2002 (JP) ..... P2002-307305

(51) Int. Cl.
*B41J 29/393* (2006.01)

(52) U.S. Cl. ..... 347/19

(58) Field of Classification Search ..... 347/86, 347/85, 84, 7, 19; 343/702
See application file for complete search history.

(56) References Cited

U.S. PATENT DOCUMENTS 5,619,237 A * 4/1997 Inoue et al. ..... 347/86
5,870,125 A * 2/1999 Swanson et al. ..... 347/87
6,302,527 B1 10/2001 Walker
6,416,152 B1 * 7/2002 Matsuzaki et al. ..... 347/19
6,459,588 B1 * 10/2002 Morizumi et al. ..... 361/737
6,585,345 B1 * 7/2003 Kosugi ..... 347/19
6,793,330 B1 * 9/2004 Usui et al. ..... 347/86
6,799,820 B1 * 10/2004 Usui et al. ..... 347/7
6,938,976 B1 * 9/2005 Siwinski et al. ..... 347/19
2002/0030710 A1 3/2002 Mochizuki et al.
2002/0063760 A1 * 5/2002 Dietl et al. ..... 347/86

FOREIGN PATENT DOCUMENTS

JP 2002-159653 * 6/2000
JP 2000-203047 A 7/2000
JP 02000203047 * 7/2000
JP 2000-255080 A 9/2000
JP 02000255080 * 9/2000
JP 2002-1991 A 1/2002

* cited by examiner

*Primary Examiner*—Anh T. N. Vo
(74) *Attorney, Agent, or Firm*—Stroock & Stroock & Lavan LLP

(57) ABSTRACT

In a liquid cartridge including a bottomed-box type container having a liquid supply port connectable to a flowing path communicating with a recording head at its bottom, a lid member for sealing an opening portion of the container body, and a communication unit which communicates data on liquid housed in the liquid cartridge with a recording apparatus by radio, an antenna portion connecting to the communication unit is formed on an upper surface of the container body.

12 Claims, 7 Drawing Sheets

LIQUID CARTRIDGE

BACKGROUND OF THE INVENTION

1. Field of the Invention

The present invention relates to a liquid cartridge storing liquid such as ink therein and supplies the liquid to a liquid ejection apparatus. Particularly, the invention relates to an ink cartridge suitable for an ink jet recording apparatus, and more specifically to an ink cartridge which transmits data on ink stored in a container to a recording apparatus side by radio communication.

2. Description of the Related Art

As disclosed in JP-A-2002-1991 (corresponding to US Patent Application No. US2002/0030710A1), an ink cartridge which transmits data on ink stored therein to a recording apparatus by radio communication has been proposed.

On the other hand, in a recording apparatus in which an ink cartridge is removably mounted on a carriage including a recording head, the ink cartridge reciprocates during a recording operation, while it receives limitation of radio output from a viewpoint of electromagnetic radiation. Therefore, for such the ink cartridge, to secure the sure communication is a practically large problem.

In order to solve such the problem, in U.S. Pat. No. 6,302,527, an ink cartridge has been disclosed, which receives radio electric power irradiated from a recording apparatus, converts the radio electric power into working electric power to operate a liquid amount sensor and a memory, and converts the data of the liquid amount sensor and the memory into radio signals thereby to transmit the radio signals to the recording apparatus by a link unit. However, its specific structure is not clear.

SUMMARY OF THE INVENTION

In view of such the problem, it is an object of invention to provide a liquid cartridge which can perform sure communication by radio output as small as possible.

In order to solve such the problem, according to the invention, in a liquid cartridge including a container having a liquid supply port connectable to a flowing path communicating with a liquid ejection head, a memory storing therein data on liquid housed in the container, and a communication unit which communicates the data in the memory to a recording apparatus by radio, the communication unit is provided on a wall opposed to a wall in which the liquid supply port is formed, and includes an antenna portion in which at least a rectangular conductive pattern is formed.

Hereby, since the antenna portion is exposed from an opening portion of a carriage, regardless of material constituting the carriage, sure communication can be performed by radio output as small as possible.

Further, in the invention, the container comprises a bottomed-box type container having the liquid supply port, and a lid member sealing an opening portion of the container body; and the antenna portion is provided so as to occupy at least 70% of one wall surface region of the container body.

Hereby, on the flat wall surface of the container body, the antenna portion having capacity necessary and enough for communication with the recording apparatus can be formed.

Further, the antenna portion may be so constituted that a conductive pattern constituting an antenna is formed on a base body. Further, the antenna portion may be so constituted that a conductive pattern constituting an antenna is formed on a base body, and the memory is mounted on the antenna portion. Furthermore, the antenna portion may be so constituted that a conductive pattern constituting an antenna is formed on a base body, and the memory and a detecting unit detecting an amount of the liquid are mounted on the antenna portion.

Thus, by forming an adhesive layer on the base body, the antenna portion can be readily fixed onto the liquid cartridge, and the memory and the detection unit detecting an amount of liquid can be mounted on the liquid cartridge.

In the invention, an expansion part is formed at one end of the base body, and the detecting unit is mounted on the expansion part.

Thus, by bending the base body, the detecting unit can be bonded onto a surface of the base body other than the surface on which the antenna portion is provided.

In the invention, the container is formed so that its width is different according to the kind of the liquid, and the antenna portion of the same specification is provided on the wall surface of the container which becomes an upper surface in a state where the cartridge is attached.

Hereby, the antenna portion of the same specification can be applied to the container different in the amount of liquid.

In the invention, a recess is formed in a region where the antenna portion is arranged, and the antenna portion is housed in the recess.

Hereby, it is possible to prevent break of the antenna portion due to a rub with another member caused in transportation of products.

In the invention, the recess is formed so that its depth is larger than a thickness of the antenna portion.

Hereby, even if the recess is sealed with a protective cover such as an adhesive tape, the adhesive is not attached onto the antenna portion and recycle of the antenna portion is facilitated.

In the invention, a protective cover material is stuck onto at least an upper surface of the antenna portion.

Hereby, it is possible to prevent break of the antenna portion due to a rub with another member caused in transportation of products.

In the invention, a lever for supporting an attachment operation is provided for the cartridge.

Hereby, it is possible to prevent the antenna portion from being touched as much as possible when the cartridge is attached.

DESCRIPTION OF THE PREFERRED EMBODIMENTS

The invention will be described below in detail with reference to shown embodiments.

Figure 1:
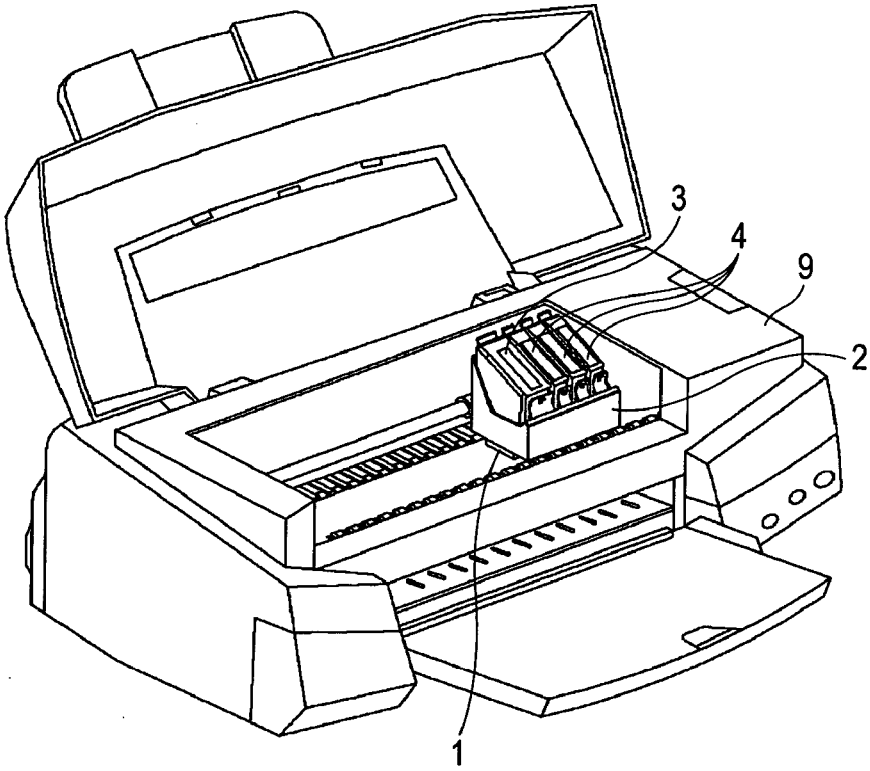
FIG. 1 is a diagram showing one embodiment of a recording apparatus in which an ink cartridge of the invention is used.

FIG. 1 shows one embodiment of an ink jet recording apparatus suitable to use an ink cartridge of the invention, in which a black ink cartridge 3 for supplying ink to the recording head 1 and plural color ink cartridges 4 are removably attached on an upper surface of a carriage 2 including an ink jet recording head on its lower surface.

Figure 2A:
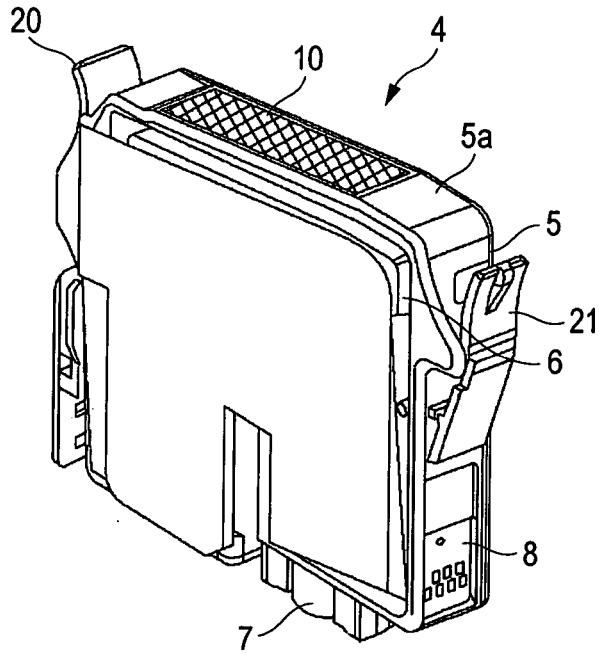
FIGS. 2A and 2B are perspective views respectively showing the front structure and the back structure of the ink cartridge of the invention.
Figure 2B:
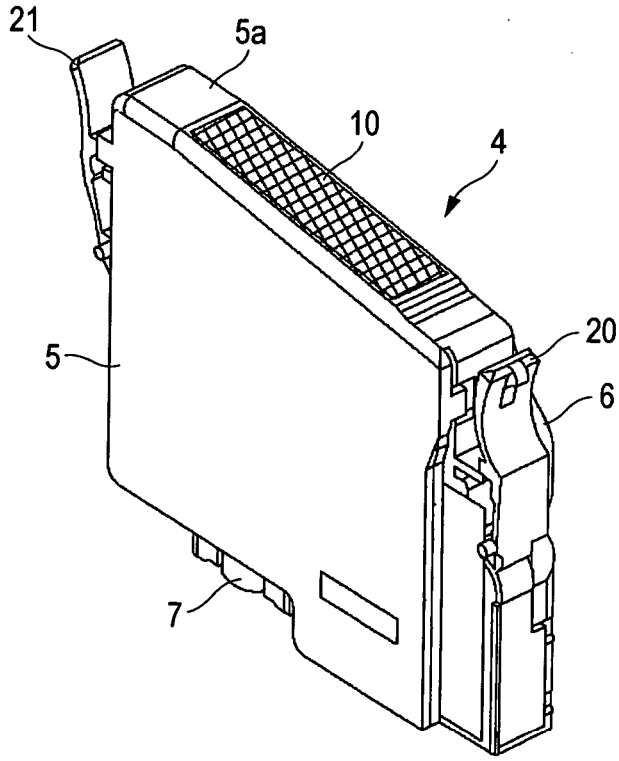

Next, one embodiment of the above ink cartridge shown in FIGS. 2A and 2B will be described, taking the color ink cartridge 4 as an example. Except that the black ink cartridge 3 is different from the color ink cartridge 4 in thickness, the black ink cartridge 3 has the same structure as the structure of the color ink cartridge 4.

In the color ink cartridge 4, a container for storing ink therein comprises a flat container body 5 which has an opening portion on one side, a nearly rectangular shape and a wall surface 5*a* at the upper portion of the container, which inclines from an ink supply port 7 side; and a lid member 6 which seals the opening portion of the container body 5.

In the container, on a wall surface intersecting a wall surface on which the ink supply port 7 is formed, at least one lever for supporting removal of the ink cartridge from the recording apparatus is provided. In this embodiment, two levers 20 and 21 are provided respectively on the wall surfaces opposite to each other.

On the upper surface 5*a* of the container body 5, a memory unit is provided, which includes an antenna portion 10 for receiving carrier waves for electric power from the recording apparatus 30 and transmitting data described later to the recording apparatus.

Figure 3A:
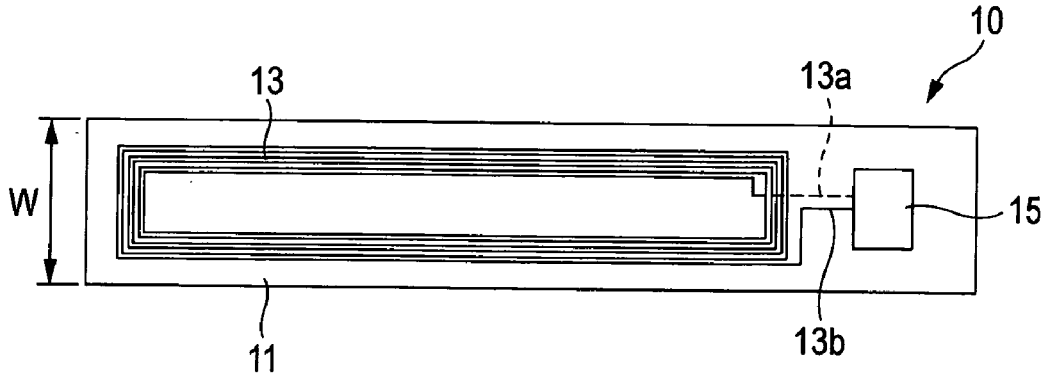
FIGS. 3A and 3B are respectively a plan view and a sectional view, showing one embodiment of an antenna attached onto the ink cartridge.
Figure 3B:
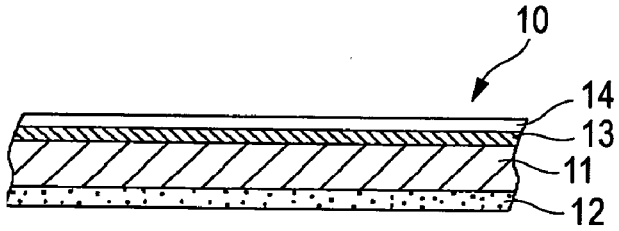

The antenna portion 10, as shown in FIGS. 3A and 3B, is formed on the upper surface 5*a* (the surface opposed to the wall on which the ink supply port 7 is formed) of the container body 5 constituting the ink cartridge, that is, at the upper portion of the container body 5 in an attachment state of the ink cartridge. The antenna portion 10 has a width that is narrower a little than a width of the upper surface 5*a*, that is, a width W that does not protrude to the lid side. Further, the antenna portion 10 includes a band-shaped electric insulation film 11 covering the upper surface 5*a* in the longitudinal direction as a base body, an adhesive layer 12 on a back surface, and a conductive layer 13 of rectangular and at least one spiral pattern on a surface. Further, according to necessity, a protective film 14 is formed on the surface of the conductive layer 13.

Of lead lines 13*a* and 13*b* of the conductive layer 13 of spiral pattern, the lead line 13*a* striding over the circumference pattern portion is connected through an insulation layer to an IC 15 mounted on the base body.

In the area in which the conductive layer 13 of the spiral pattern is not formed, of the thus constructed antenna portion 10, the IC 15 having a semi-conductive memory element such as an EEPROM (electrically erasable programmable read-only memory) is mounted and connected to the conductive layer 13 of the antenna portion 10 to constitute the memory unit (non-contact IC tag). This memory unit is stuck through the adhesive layer 12 onto the upper surface 5*a* of the container body 5. The antenna portion 10, particularly the conductive layer 13 of rectangular and at least one spiral pattern is so constituted as to occupy at least 70% of the area of the stuck surface of the container. The size of the conductive layer 13 is selected so as to obtain increase of efficiency of transmission and reception of radio signals, and sufficient adhesive strength.

Figure 4:
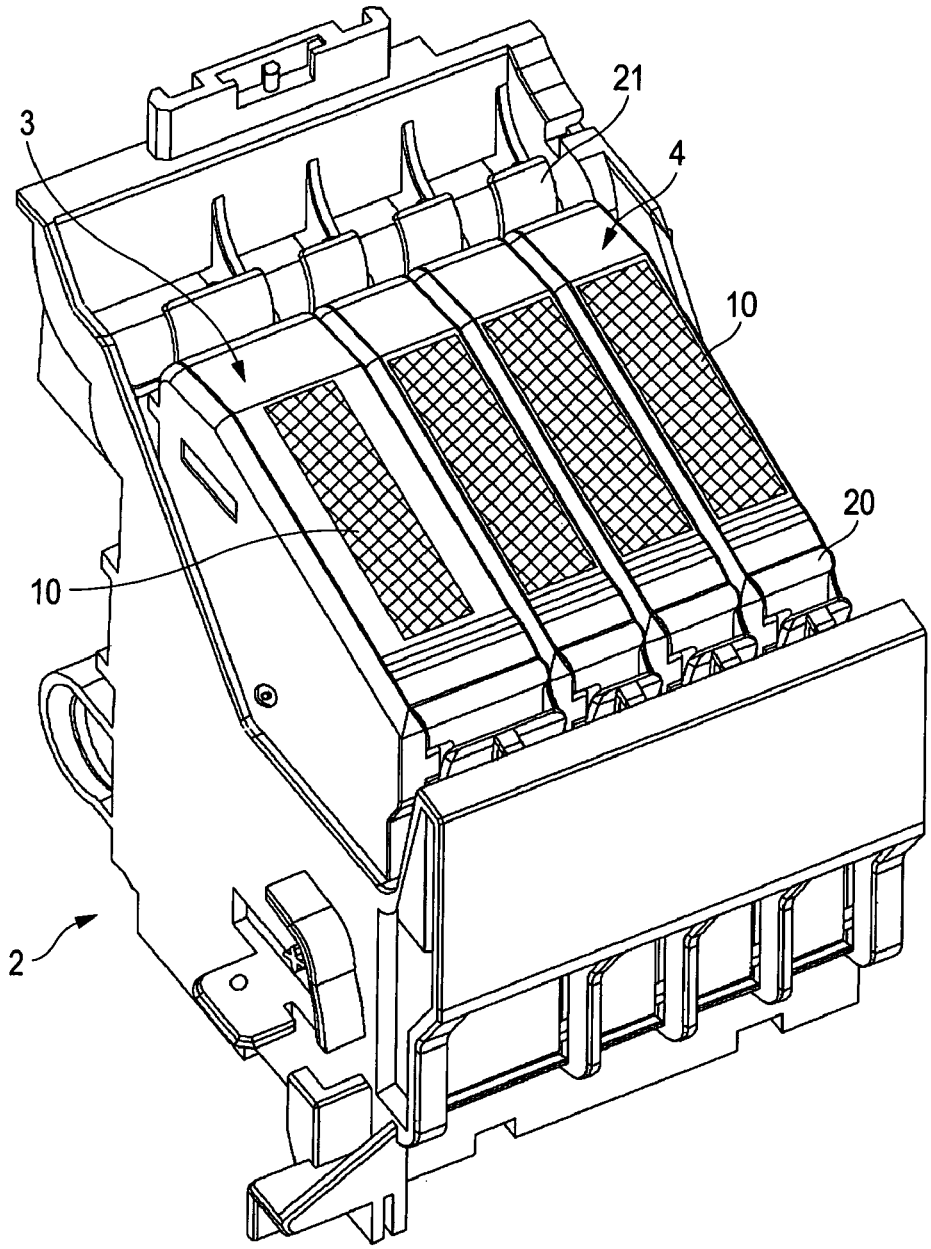
FIG. 4 is a perspective view showing a state where the ink cartridge has been attached onto a carriage.

According to this embodiment, in the state where the ink cartridge is attached on the carriage 2, as shown in FIG. 4, the antenna portion 10 is exposed from the opening of the carriage 2. Therefore, even if the carriage is made of the conductive material, without receiving shield, an antenna on the recording apparatus side is arranged in an upper lid 9 (FIG. 1) of a case constituting the recording apparatus, whereby sure communication can be performed with transmission power as small as possible.

Further, this cartridge is removed with the levers 20 and 21 formed at the container body 5 gripped. Therefore, due to the erroneous touch onto the antenna portion 10, external force in the peeling-off direction is not applied onto the antenna portion 10.

Further, since the antenna portion 10 is arranged on the upper surface 5*a* (surface opposed to the surface on which the ink supply port 7 is formed) of the cartridge, an accident such as a short circuit due to the ink that has leaked from the ink supply port 7 can be prevented.

The above embodiment has been described, taking the color ink cartridge 4 as an example. However, since the black ink cartridge 3 is larger in width than the color ink cartridge 4, the same antenna portion 10 can be provided for the black ink cartridge 3 as shown in FIG. 4. Namely, the antenna portion of the same specification can be applied to the containers which are different in the ink amount.

Figure 5:
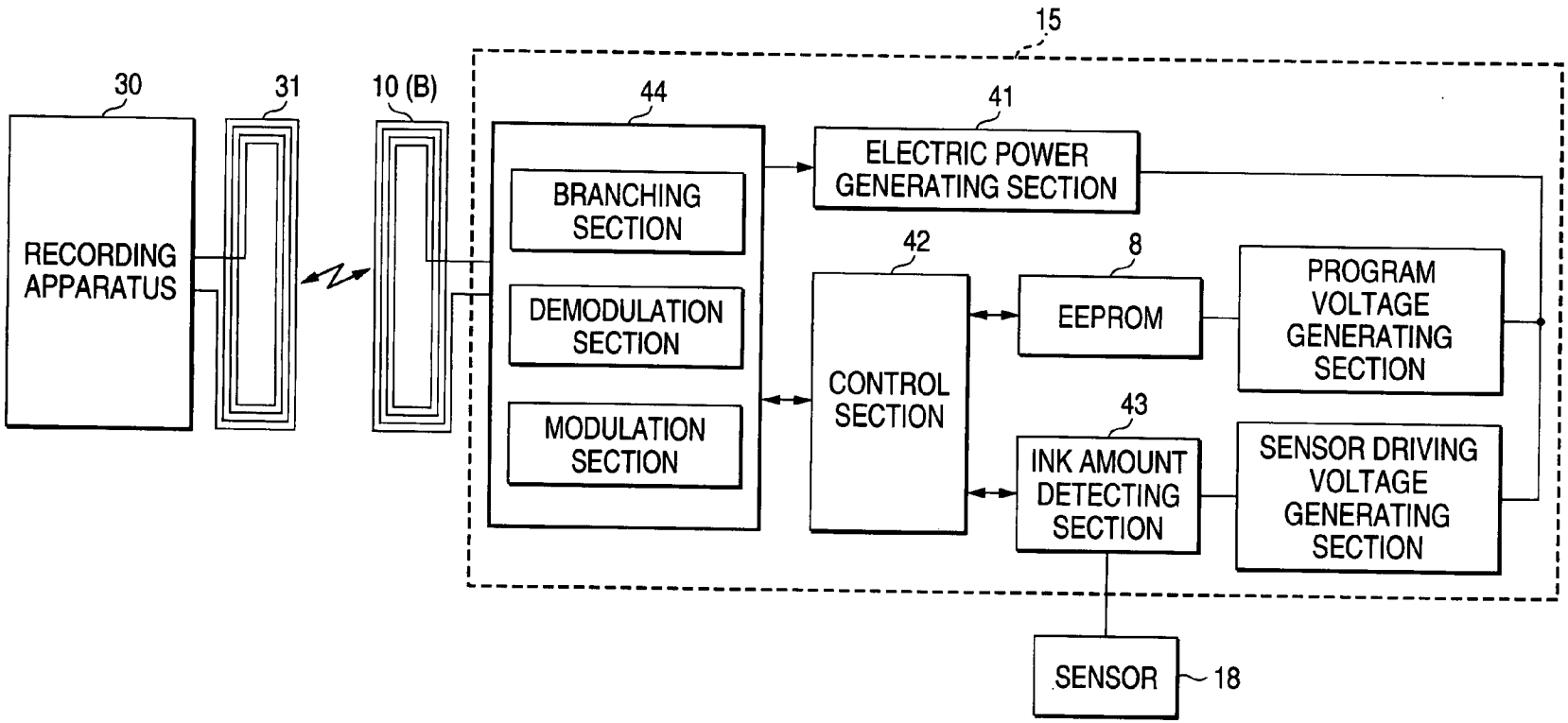
FIG. 5 is a block diagram showing a system by which the ink cartridge executes communication with a recording apparatus body.

FIG. 5 shows one embodiment of a system which executes communication with the recording apparatus. When the carriage 2 moves to the predetermined position, a not-shown control section of the recording apparatus 30 detects this movement and outputs carrier waves from an antenna portion 31. The carrier wave received by the antenna portion 10 of the ink cartridge 4 inputs through a branching section into only an electric power generating section 41, and is converted into DC electric power to become working electric power. Its working electric power charges a not shown storage unit.

When the time necessary to charge the storage unit has passed, the recording apparatus stops the transmission of the carrier waves. When a control section 42 and a sensor 18 receive supply of power from the storage unit, an ink amount detecting section 43 calculates the amount of the residual ink on the basis of signals from the sensor 18, and data of the ink stored in the memory section (EEPEOM) 8 is read out. These data are transmitted by a high-frequency transmit-receive section 44 as a high-frequency signal from the antenna portion 10 to the recording apparatus 30.

As described above, by repeating the above operation at the predetermined period, the communication between the ink cartridge 4 and the recording apparatus 30 can be performed.

Figure 6:
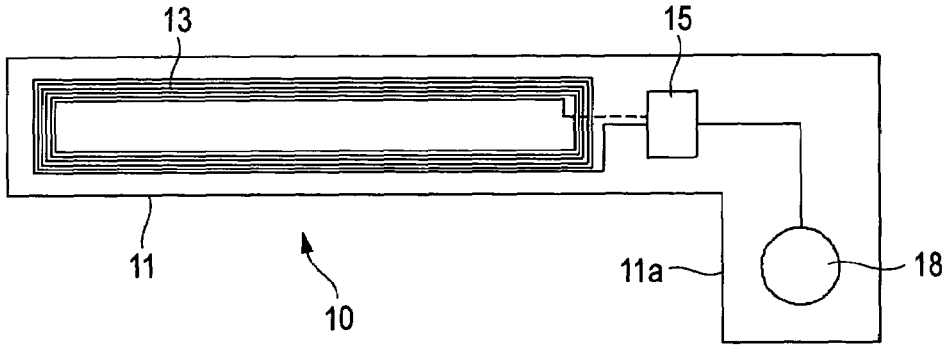
FIG. 6 is a plan view showing another embodiment of the antenna portion which can be applied to the ink cartridge of the invention.

FIG. 6 shows another embodiment of the memory unit having the antenna portion 10, in which an expansion part 11*a* is formed at one end portion of an electrically insulating film 11, and a liquid surface sensor 18 is fixed to this expansion part 11*a*. In the figure, the same members as those in the former embodiment or the materials corresponding to those in the former embodiment are denoted by the same reference numerals.

According to this embodiment, by sticking the memory unit onto the container constituting the ink cartridge, the liquid surface sensor 18 can be attached to the ink cartridge. Further, since the liquid surface sensor 18 is mounted on the expansion part 11*a*, by bending the region of this expansion part, the liquid surface sensor 18 can be arranged on the wall surface different from the wall surface on which the antenna portion 10 of the memory unit is fixed.

Figure 7:
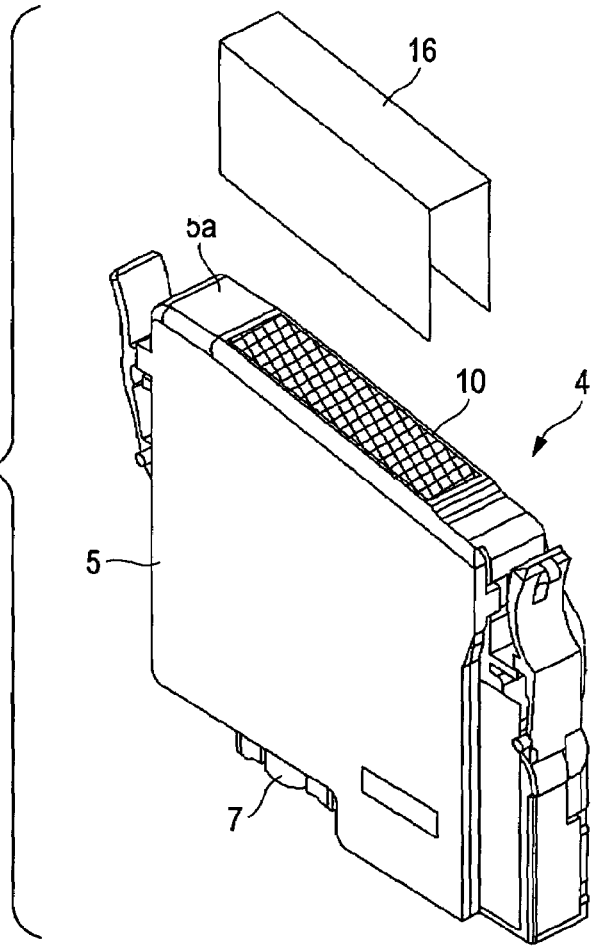
FIG. 7 is a perspective view showing another embodiment of the ink cartridge of the invention.

In the above embodiments, the antenna portion 10 is exposed. However, as shown in FIG. 7, in case that a protective cover material 16 to which an adhesive is applied is stuck on at least a surface of the antenna portion 10, and preferably so as to cover side surfaces of the cartridge, it is possible to prevent break of the antenna portion 10 due to a rub with another member caused in transportation of products.

Figure 8A:
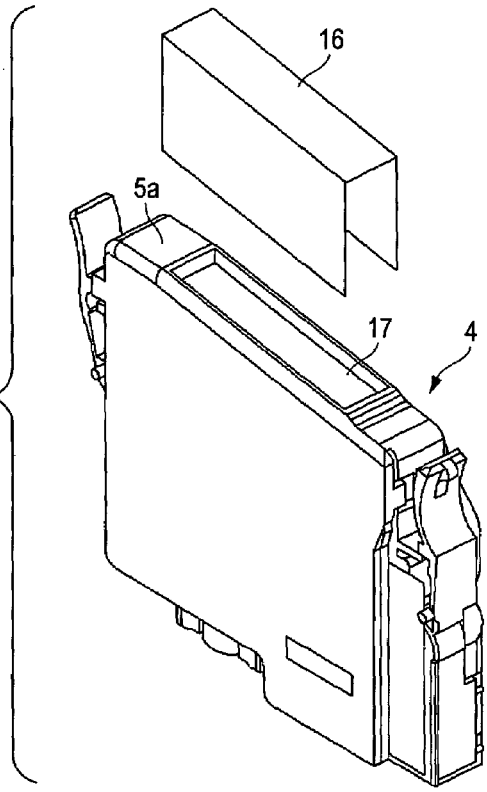
FIGS. 8A, 8B, and 8C are respectively a perspective view of an ink cartridge in another embodiment of the invention, and diagrams showing sectional structure of an antenna portion in the ink cartridge.

Further, as shown in FIG. 8A, a recess portion 17 having such a depth that the antenna portion 10 can be housed may be formed in one surface of the container body 5 constituting the ink cartridge 4, for example, in the upper surface 5*a* thereby to house the antenna portion 10 in this recess portion 17. In this case, it is preferable that the IC 15 mounted on the antenna portion 10 can be also housed in the recess portion.

Figure 8B:
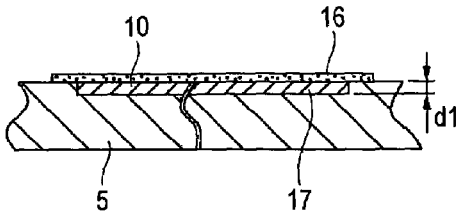

According to this embodiment, as shown in FIG. 8B, since the upper surface of the antenna portion 10 is located lower than the surface of the container body 5, the rub can be surely prevented. In order to obtain sureness, opening of the recess portion 17 may be sealed by the protective cover material 16.

Figure 8C:
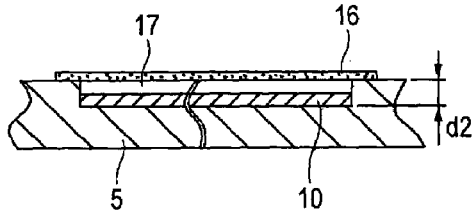

Further, as shown in FIG. 8C, in case that a depth d2 of the recess portion 17 is made larger than a thickness d1 of the antenna portion 10, contact with the adhesive layer comprising an adhesive tape, of the protective cover material 16 is prevented, whereby the antenna portion can be readily reused.

What is claimed is:

1. A liquid cartridge comprising:

a container having a liquid supply port connectable to a flowing path communicating with a recording head of liquid jet printer, said container being a bottomed-box type container having said liquid supply port, and a lid member sealing an opening portion of said container;

a memory unit including a memory section storing therein data about a liquid housed in the container and an electric power generating section; and an antenna portion provided on a wall opposed to a wall in which said liquid supply port is formed, and including a rectangular conductive pattern electrically connected to said memory unit, which communicates the data in said memory section to a recording apparatus by radio, and said antenna portion can receive a carrier wave, which is converted into DC electric power by said electric power generating section to become working electric power, wherein the carrier wave is transmitted from the recording apparatus, and after stopping transmission of the carrier wave, the memory unit calculates an amount of said liquid housed in the container based on a signal from a sensor, and the amount of said liquid and said data about said liquid stored in the memory section are transmitted from said antenna portion to the recording apparatus.

2. The liquid cartridge according to claim 1, wherein said antenna portion is formed with a base body on which the conductive pattern is provided.

3. The liquid cartridge according to claim 2, wherein said memory unit and the sensor are provided on said base body.

4. The liquid cartridge according to claim 3, wherein an expansion part is formed at one end of said base body, and said sensor is mounted on said expansion part.

5. The liquid cartridge according to claim 2, wherein said antenna portion is formed of a conductive layer formed on a rectangular said base body, said conductive layer having a rectangular and at least one spiral pattern.

6. The liquid cartridge according to claim 2, wherein said conductive pattern of said antenna portion is provided so as to occupy at least 70% of one wall surface region of said container.

7. The liquid cartridge according to claim 1, wherein said antenna portion is formed with the conductive pattern constituting an antenna on a base body and by mounting said memory unit.

8. The liquid cartridge according to claim 1, wherein said container is formed so that a width thereof is different according to a kind of the liquid, and another antenna portion of the same specification is provided on a wall opposed to a wall of said container on which said liquid supply port is formed.

9. The liquid cartridge according to claim 1, wherein a recess is formed in a region where said antenna portion is arranged, and the antenna portion is housed in said recess.

10. The liquid cartridge according to claim 9, wherein said recess is formed so that a depth thereof is larger than a thickness of said antenna portion.

11. The liquid cartridge according to claim 1, wherein a protective cover material is stuck onto at least an upper surface of said antenna portion.

12. The liquid cartridge according to claim 1, wherein a lever supporting an attachment operation is provided on at least one wall surface.

* * * * *